US008864467B1

(12) United States Patent
Liang

(10) Patent No.: US 8,864,467 B1
(45) Date of Patent: Oct. 21, 2014

(54) TURBINE BLADE WITH SERPENTINE FLOW COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 491 days.

(21) Appl. No.: 13/358,845

(22) Filed: Jan. 26, 2012

(51) Int. Cl.
*F01D 5/18* (2006.01)

(52) U.S. Cl.
USPC ..... 416/96 R; 416/97 R

(58) Field of Classification Search
CPC ... F01D 5/187; F01D 25/12; F05D 2260/201; F05D 2260/204
USPC ..... 415/115; 416/96 R, 97 R
See application file for complete search history.

(56) References Cited

U.S. PATENT DOCUMENTS

| | | | | | |
|---|---|---|---|---|---|
| 4,604,031 | A * | 8/1986 | Moss et al. | ..... | 416/97 R |
| 5,073,086 | A | 12/1991 | Cooper | | |
| 5,403,157 | A * | 4/1995 | Moore | ..... | 416/96 R |
| 6,036,440 | A * | 3/2000 | Tomita et al. | ..... | 416/96 R |
| 6,139,269 | A * | 10/2000 | Liang | ..... | 416/97 R |
| 6,227,804 | B1 * | 5/2001 | Koga et al. | ..... | 416/96 R |
| 6,439,848 | B2 | 8/2002 | Haehnle et al. | | |
| 6,939,102 | B2 | 9/2005 | Liang | | |
| 7,217,097 | B2 | 5/2007 | Liang | | |

* cited by examiner

*Primary Examiner* — Ninh H Nguyen
(74) *Attorney, Agent, or Firm* — John Ryznic

(57) ABSTRACT

A turbine rotor blade with a serpentine flow cooling circuit, especially a blade with a wide open tip turn, where the tip turn includes a main rib separating the two legs that are connected to the tip turn and include a bleed cooling air hole with a mini rib formed along side the main rib in the downstream leg from the tip turn in which bleed cooling air from the upstream leg flows through the hole and is impinged onto the mini rib. The bleed cooling air not only provides additional cooling for the tip turn region of the blade but eliminates the separation and recirculation issues creates in tip turns of the prior art. The bleed cooling air hole and mini rib can also be used in the root turn.

5 Claims, 4 Drawing Sheets

TURBINE BLADE WITH SERPENTINE FLOW COOLING

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to a turbine rotor blade with a serpentine flow cooling circuit having additional turn channel cooling features.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

FIG. 1 shows a prior art turbine rotor blade with a three pass aft flowing serpentine flow cooling circuit 11 with trip strips 12 along the walls of each serpentine circuit channel. A tip turn channel 15 is formed at the blade tip that connects the first leg to the second leg of the serpentine flow circuit, and a root turn channel 19 is formed in the blade root that connects the second leg to the third leg.

FIG. 2 shows a detailed close-up view of the tip turn channel 15 in FIG. 1. The tip turn 15 has a wide open tip turn. For a conical blade tip turn design like that is FIGS. 1 and 2, the downstream turn flow area is much greater than the upstream flow area and thus creates a flow separation and recirculation at locations identified as 17 in FIG. 2. A result of this separation and recirculation of the cooling air flow is that an over-temperature is produced at these locations. An over-temperature is like a hot spot on the blade which leads to erosion damage and thus a shortened part life. This is a major issue for industrial gas turbine engine blades, since these engines must be capable of continuous operation for 40,000 hours or more.

Several prior art patents attempt to address this issue of an over-temperature at the blade tip turns. U.S. Pat. No. 5,073,086 issued to Cooper on Dec. 17, 1991 and entitled COOLED AERFOIL BLADE discloses adding extra material downstream of the turn. U.S. Pat. No. 6,439,848 issued to Haehnle et al on Aug. 27, 2002 and entitled DRILLED COOLING AIR OPENINGS IN GAS TURBINE COMPONENTS discloses adding a bleed hole to purge the flow recirculation and incorporate a turning guide vane in the tip turn region. U.S. Pat. No. 6,939,102 issued to Liang on Sep. 6, 2005 and entitled FLOW GUIDE COMPONENT WITH ENHANCED COOLING discloses t at cooling air is pushed outward for cooling the squealer tip floor and corners while a vortex chamber is used in the middle of the tip turn to provide not only cooling of the tip turn but also purge air for the separation area downstream of the tip turn. U.S. Pat. No. 7,217,097 issued to Liang on May 15, 2007 and entitled COOLING SYSTEM WITH INTERNAL FLOW GUIDE WITHIN A TURBINE BLADE OF A TURBINE ENGINE discloses using a guide vane in the separation flow channel to improve both the tip turn and the root turn flows.

BRIEF SUMMARY OF THE INVENTION

A turbine rotor blade with a serpentine flow cooling circuit with a tip turn and a root turn connecting adjacent legs of the serpentine, especially for a blade with a wide open tip turn. A main rib separates the legs of the serpentine circuit that are connected to the tip turn channel. A bleed cooling air hole is formed in the main rib to bleed off some of the cooling air from the upstream leg before the tip turn and discharge the bleed cooling air against a mini rib formed in the downstream leg after the tip turn to impinge onto the mini rib. The bleed cooling air provides additional impingement cooling for the tip turn region of the blade as well as eliminates flow separation or recirculation issues created in the tip turns of the prior art blades.

In another embodiment, the root turn of the serpentine flow circuit can also include a bleed cooling air hole formed in the main rib that discharges the bleed cooling air onto a mini rib located in the downstream leg of the root turn to provide additional root turn cooling and to eliminate flow separation or recirculation issues in the root turn.

DETAILED DESCRIPTION OF THE INVENTION

Figure 1:
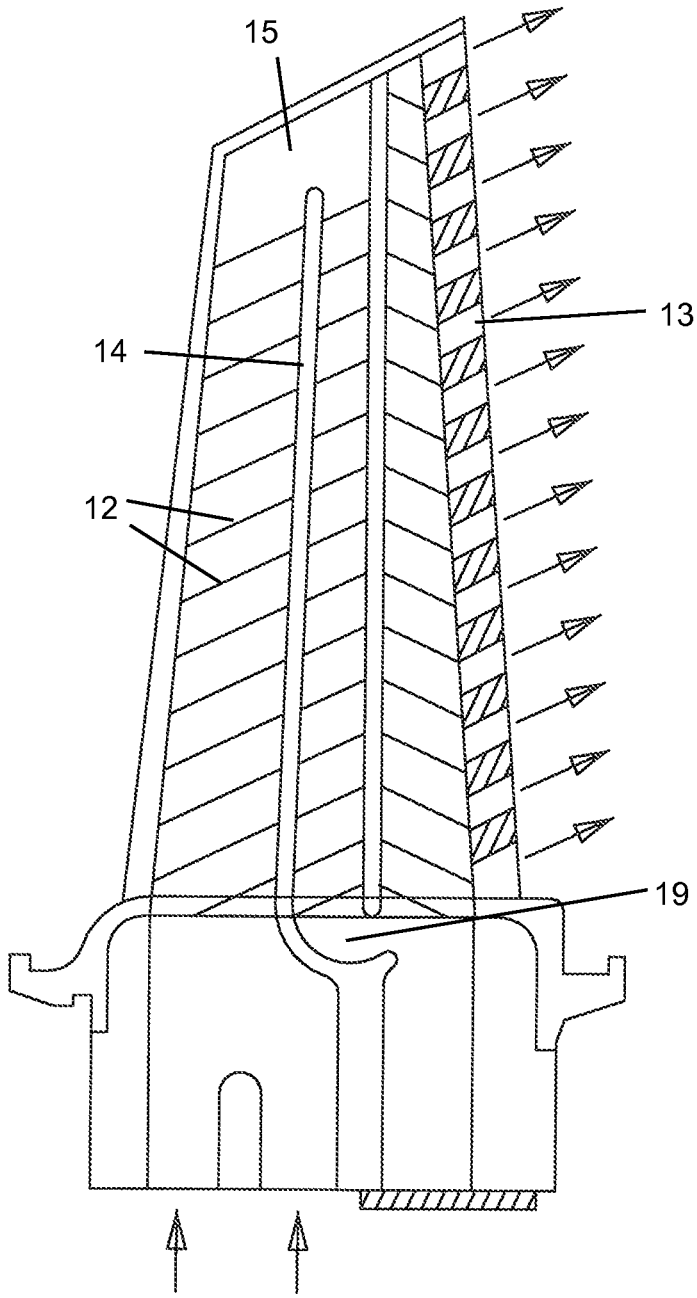
FIG. 1 shows a prior art turbine rotor blade with a serpentine flow cooling circuit having a wide open tip turn.
Figure 2:
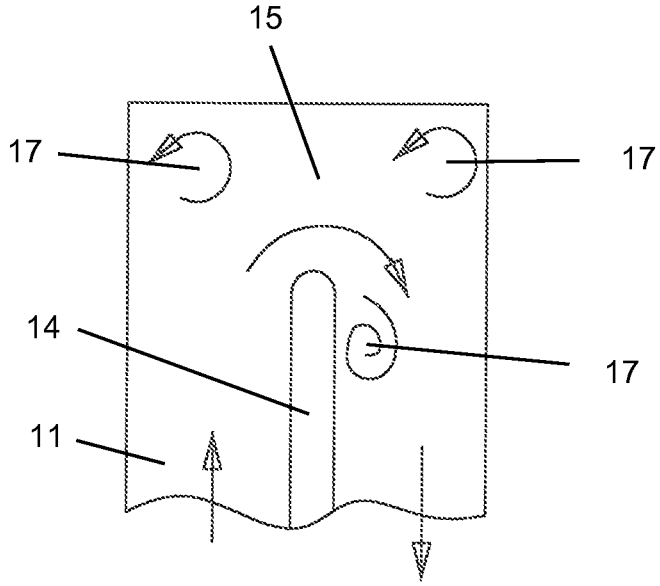
FIG. 2 shows a detailed view of the tip turn of the serpentine flow cooling circuit for the blade in FIG. 1 with flow separation areas.
Figure 3:
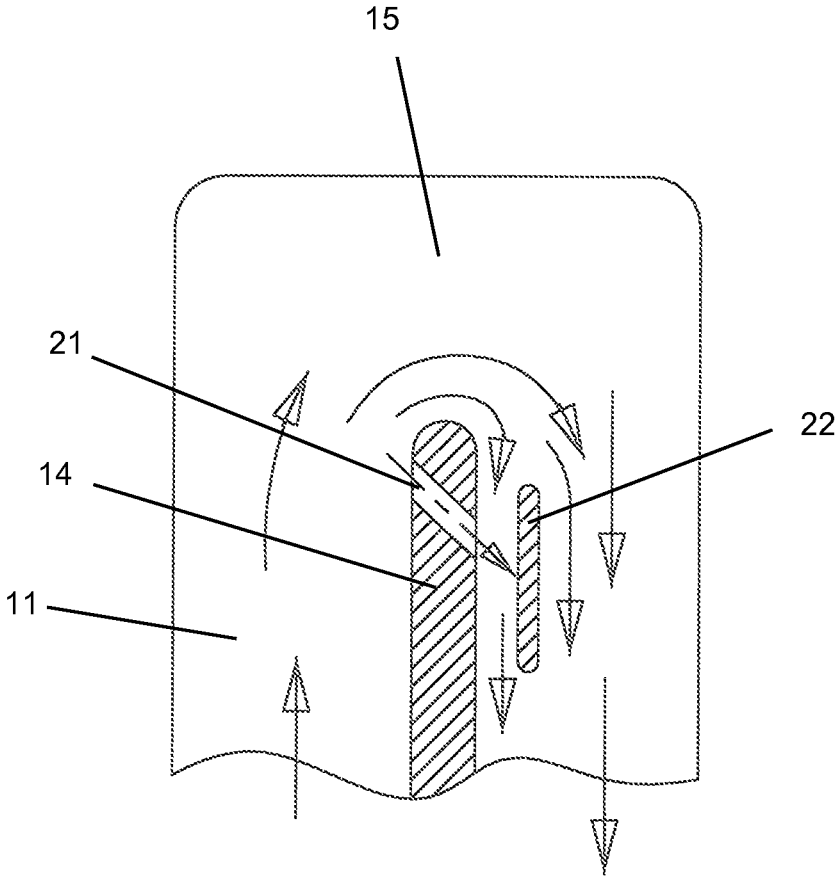
FIG. 3 shows a detailed view of a blade tip turn with the structure of the present invention.
Figure 4:
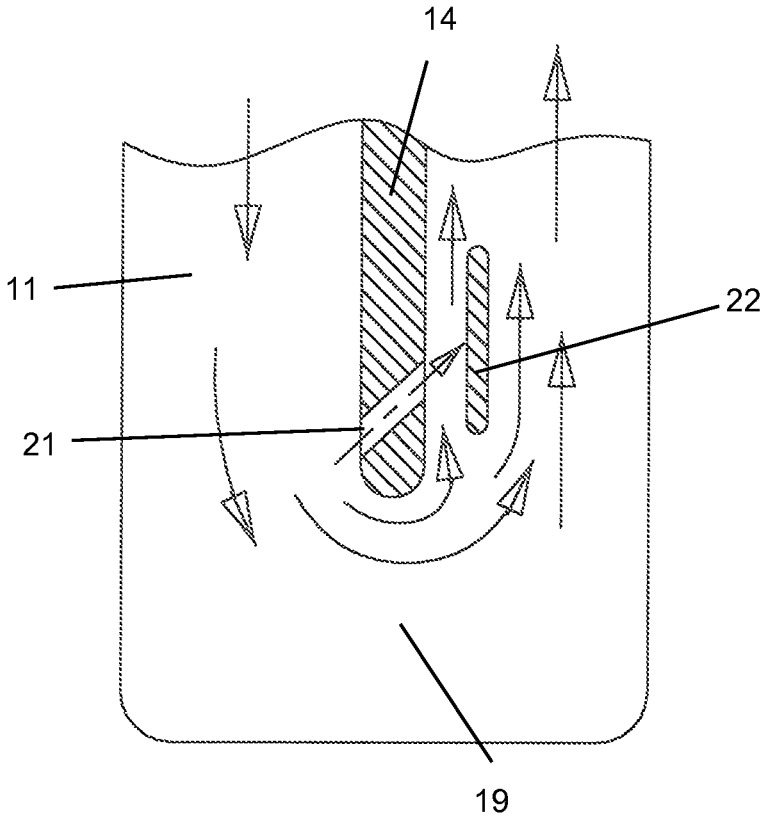
FIG. 4 shows a detailed view of a blade root turn with the structure of the present invention.

The present invention is a turbine rotor blade with a serpentine flow cooling circuit having tip turns and root turns each with a wide open turn. FIG. 3 shows the tip turn and FIG. 4 shows the root turn of the serpentine flow cooling circuit for the turbine rotor blade with the improvements of the present invention. In FIG. 3, the tip turn includes a first leg that flows into the tip turn 15 which then flows into a second leg that flows toward the root of the blade. a mini rib 22 is located in the second leg just below a top surface of the rib 14 that separates the first and second legs and extends down just below an outlet of a bleed hole 21 that is angled downward as seen in FIG. 3. The mini rib 22 forms a cooling air passage for the cooling air that is bled off from the first leg before making the tip turn.

FIG. 4 shows the blade with the serpentine flow cooling circuit and a detailed view of the root turn 19 that connects the second leg to the third leg which flows up toward the blade tip. a mini rib 22 is also located in the third leg just above the end of the rob 14 that separates the second leg from the third leg and extends up just passed the opening of the bleed hole that is angled upward as seen in FIG. 4. The mini rib 22 also forms a cooling air passage for the cooling air that is bled off from the second leg before making the root turn.

The mini ribs and the bleed holes connected to the upstream leg of the turns will eliminate the flow separation issues described above in the prior art. The mini ribs are positioned close to the main airfoil rib at a location where the flow separation or recirculation would occur. Cooling air bleed holes that are angled in a direction of the cooling air flow after the turns are formed in the main rib.

In operation, the bleed hole discharges some of the cooling air from the upstream leg of the serpentine flow circuit just upstream from the turn and into the leg downstream from the turn in the space between the main rib and the mini rib. The bleed air creates an ejector effect in the flow channel that will entrain the cooling air in the turn into the flow channel. This eliminates the cooling air flow separation and recirculation at the downstream locations of the turn. Also, the bleed cooling air will also impinge onto the mini rib and create a higher rate of impingement heat transfer coefficient for the turn region cooling for both the tip turn and the root turn. The mini ribs and bleed holes can also be used in non-conical turns and the root turns as well in order to improve cooling for the roots and tip turns region of the blades.

The blade of the present invention is shown with a three pass serpentine flow cooling circuit having three legs with just one tip turn and one root turn. However, five pass serpentine flow circuits having two tip turns and two root turns can also make use of the bleed cooling air holes and mini ribs of the present invention.

I claim the following:

1. A turbine rotor blade comprising:

an airfoil extending from a root and platform;

a serpentine flow cooling circuit formed within the airfoil;

the serpentine flow cooling circuit having a turn channel connecting an upstream leg to a downstream leg;

a main rib separating the upstream leg from the downstream leg;

a bleed cooling air hole located in the rib near to the turn channel;

a mini rib located in the downstream channel and positioned to impinge the bleed cooling air discharged from the bleed cooling air hole; and, the bleed cooling air hole is angled downward in a direction of the cooling air flow through the serpentine flow cooling circuit and toward the mini rib.

2. A turbine rotor blade comprising:

an airfoil extending from a root and platform;

a serpentine flow cooling circuit formed within the airfoil;

the serpentine flow cooling circuit having a turn channel connecting an upstream leg to a downstream leg;

a main rib separating the upstream leg from the downstream leg;

a bleed cooling air hole located in the rib near to the turn channel;

a mini rib located in the downstream channel and positioned to impinge the bleed cooling air discharged from the bleed cooling air hole; and, the mini rib extends short of an end of the main rib and just past the bleed cooling air hole opening.

3. A turbine rotor blade comprising:

an airfoil extending from a root and a platform;

a serpentine flow cooling circuit formed within the airfoil;

the serpentine flow cooling circuit having a turn channel connecting an upstream leg to a downstream leg;

a main rib separating the upstream leg from the downstream leg;

a mini rib located in the downstream channel and not in the turn channel; and, a bleed cooling air hole formed in the main rib connecting the upstream leg to the downstream leg and directed to discharge impingement cooling air onto the mini rib.

4. The turbine rotor blade of claim 3, and further comprising:

the bleed cooling air hole is angled downward in a direction of the cooling air flow.

5. The turbine rotor blade of claim 3, and further comprising:

the mini rib and the bleed air cooling hole are both located in the upstream leg and the downstream leg adjacent to the turn channel.

* * * * *